US005819851A

United States Patent [19]

Dallas

[11] Patent Number: 5,819,851

[45] Date of Patent: Oct. 13, 1998

[54] BLOWOUT PREVENTER PROTECTOR FOR USE DURING HIGH PRESSURE OIL/GAS WELL STIMULATION

[76] Inventor: L. Murray Dallas, 801 New England Ct., Allen, Tex. 75002

[21] Appl. No.: 783,860

[22] Filed: Jan. 16, 1997

[51] Int. Cl.[6] ..... E21B 33/068

[52] U.S. Cl. ..... 166/308; 166/86.1; 166/87.1; 166/90.1; 166/386; 166/387

[58] Field of Search ..... 166/308, 386, 166/387, 86.1, 87.1, 90.1

[56] References Cited

U.S. PATENT DOCUMENTS

| | | | |
|---|---|---|---|
| 4,076,079 | 2/1978 | Herricks et al. | 166/387 X |
| 4,832,128 | 5/1989 | Light et al. . | |
| 4,993,488 | 2/1991 | McLeod . | |
| 5,012,865 | 5/1991 | McLeod . | |
| 5,332,044 | 7/1994 | Dallas et al. | 166/386 |
| 5,372,202 | 12/1994 | Dallas | 166/386 |

*Primary Examiner*—Roger J. Schoeppel
*Attorney, Agent, or Firm*—Dority & Manning, P.A.

[57] ABSTRACT

An apparatus for protecting blowout preventers during well fracturing and/or stimulation treatments is disclosed. The apparatus includes a hollow spool with spaced-apart inner and outer sidewalls that define an annular cavity. A mandrel is forcibly reciprocatable in the cavity. The mandrel includes an annular seal at a bottom end for sealingly engaging a bit guide attached to a top end of the casing. The apparatus is mounted above a BOP attached to a casing spool of the well before well stimulation procedures are begun. The mandrel is stroked down through the BOP to protect it from exposure to fluid pressure as well as abrasive and/or corrosive well stimulation fluids, especially extreme pressures and abrasive proppants. The advantage is a simple, easy to operate apparatus for protecting BOPs which provides full access to the well casing with well servicing tools to facilitate well stimulation at pressures approaching the burst pressure rating of the well casing.

45 Claims, 5 Drawing Sheets

BLOWOUT PREVENTER PROTECTOR FOR USE DURING HIGH PRESSURE OIL/GAS WELL STIMULATION

TECHNICAL FIELD

The present invention relates to equipment for servicing oil and gas wells and, in particular, to apparatus for protecting blowout preventers from high pressures and exposure to abrasive and/or corrosive fluids during well fracturing and/or stimulation procedures and a method of servicing oil and gas wells using same. An apparatus for protecting blowout preventers is disclosed in U.S. application Ser. No. 08/661,995 for Blowout Preventer Protection and Method of Using Same During Oil and Gas Well Stimulation, the entire disclosure of which is incorporated by referenced herein.

BACKGROUND OF THE INVENTION

The servicing of oil and gas wells to stimulate production requires the pumping of fluids under high pressure. The fluids are generally corrosive and/or abrasive because they are frequently laden with corrosive acids and/or abrasive proppants such as sharp sand. Some hydrocarbon producing formations require stimulation at extreme pressures to break up the formation and improve the flow of hydrocarbons to the well. If such wells are equipped with a wellhead, it is advantageous to use specialized tools called wellhead isolation tools which are inserted through the wellhead and related equipment to isolate pressure sensitive components from the extreme pressures required to stimulate those wells. Wellhead isolation tools are taught, for example, in U.S. Pat. Nos. 4,867,243, 5,332,044 and 5,372,202 which issued to the applicant respectively on Sep. 19, 1989, Jul. 26, 1994 and Dec. 13, 1994.

In other wells, stimulation to improve production can be accomplished at more moderate pressures which may be safely contained by blowout preventers (BOPs) attached to the well casing. In those instances, some operators remove the wellhead equipment and pump stimulation fluids directly through a valve attached to the BOPs. This procedure is adopted to minimize expense and to permit full access to the well casing with tools such as logging tools, perforation guns and the like during the well servicing operation. When pumping abrasive fluids into a well, the pump rate must be kept high to place the proppant without "screening out," in which a blockage occurs and all the equipment including the high pressure lines are blocked with abrasives injected under high pressure. When the pump rate is high or large quantities of proppant are pumped, the BOPs may be damaged by the cutting action of the proppant. If high rates of abrasive proppant are pumped through a BOP, the blind rams of the BOP or the valve gates can be "washed out" so that the BOP becomes inoperable.

In addition to wellhead isolation tools, casing savers are also used to protect wellhead equipment from extreme pressures and well stimulation fluids. Casing packers as described in U.S. Pat. No. 4,939,488 which issued Feb. 19, 1991 to McLeod have likewise been used. While casing savers and packers are useful in protecting wellhead equipment including BOPs, they have the disadvantage of restricting access to the casing because they constrict the through bore diameter from the high pressure valve to the casing. This restricts flow which can limit the pump rate. It also interferes with running servicing tools such as perforating guns, plug setters, or other such tools into the casing. It is advantageous to be able to run tools during well servicing operations so that multi-zone wells can be serviced in a single set without changing the wellhead or wellhead isolation equipment. Furthermore, the well casing packer taught by McLeod can only be set in a well which is not under pressure at the beginning or end of a servicing operation. It cannot be used in wells with any natural pressure, and is therefore very limited in its utility.

If stimulation treatments are to exceed pressures at which the wellhead equipment is rated, a wellhead isolation tool, a casing saver or a casing packer have to date been the only tools available for isolating the wellhead from extreme pressure and abrasion. Although it is not uncommon for certain wells to be stimulated at pressures which do not exceed the pressure rating of the wellhead equipment (about 5000 psi), it is also quite common that wells require extreme pressure treatments (usually in the range of 10,000–15,000 psi) for production stimulation. If the stimulation pressures are in the moderate range of 5,000 psi or less, well stimulation can be accomplished directly through the BOPs, but unless the BOPs are protected from the abrasive and/or corrosive fluids used in the stimulation processes, there is considerable risk that the BOPs will be damaged and may be damaged to an extent that the well must be killed and the BOPs replaced because they are no longer functional. If the stimulation pressures are higher than 5,000 psi the BOPs must be protected from the pressure as they are not constructed to contain extreme pressures. Regardless of the stimulation pressures, it has become increasingly evident that it is advantageous to have full access to the well casing during a well stimulation treatment. Full access to the casing permits the use of downhole tools which are often required, or at least very advantageously used, during a stimulation treatment. If a downhole tool is required during a stimulation treatment using a tree saver, a casing saver or casing packer, it must be pulled before the tool can be inserted into the casing. This is time consuming and expensive for the well owner who must often pay service crews to stand by or to take down and set up again, all of which contributes to production expense. It is therefore preferable that full access to the well casing be provided whenever a stimulation treatment is performed.

It is therefore a primary object of the invention to provide a protector for a BOP which will protect the BOP from damage due to exposure to high pressures, abrasive proppants and/or corrosive stimulation fluids.

It is a further object of the invention to provide a protector for a BOP which protects the BOP from well stimulation pressures and fluids without restricting access to the well casing so that well servicing tools such as perforating guns, plug setters, logging tools or other related equipment can be run into and out of the well while the protector for the BOP is in place.

It is yet a further object of the invention to provide a protector for a BOP which is simple to manufacture, easy to use and capable of containing even extreme well stimulation pressures.

It is still a further object of the invention to provide a method of stimulating wells using high pressures while protecting a BOP mounted to a top of the well from exposure to excessive pressures and abrasive and/or corrosive fluids.

SUMMARY OF THE INVENTION

These and other objects of the invention are realized in an apparatus for protecting a blowout preventer from exposure to fluid pressure as well as abrasive and/or corrosive fluids during a well fracturing and/or stimulation treatment to stimulate production, comprising:

a spool having a spool top end, a spool bottom end, and spaced-apart inner and outer sidewalls that extend between the spool top end and the spool bottom end;

the spool bottom end being adapted to be mounted above a blowout preventer;

the spool top end being adapted for the attachment of another spool or a valve;

a mandrel having a mandrel top end and a mandrel bottom end, the mandrel top end being received in an annular cavity between the inner and outer sidewalls and forcibly reciprocatable within the cavity, and the mandrel bottom end including annular sealing means for high pressure sealing engagement with a top end of a casing of the well;

whereby, when the spool is mounted above a blowout preventer, the mandrel can be stroked down through the blowout preventer until the annular sealing means sealingly engages a top end of the casing to isolate the blowout preventer and protect it from exposure to fluid pressure as well as abrasive and/or corrosive fluids during well stimulation treatments, and stroked up out of the blowout preventer after the well has been stimulated.

In accordance of a further aspect of the invention, there is provided a method of fracturing or stimulating a well having at least one blowout preventer attached to a casing of the well, comprising the steps of:

a) mounting above the blowout preventer an apparatus for protecting the blowout preventer from exposure to fluid pressure as well as abrasive and/or corrosive fluids during the well fracturing and/or stimulation treatment to stimulate production, the apparatus comprising a protector spool having a spool top end, a spool bottom end, and spaced-apart inner and outer sidewalls that extend between the spool top end and the spool bottom end, the spool bottom end being adapted to be mounted above the blowout preventer; the spool top end being adapted for the attachment of another spool or valve, and a mandrel having a mandrel top end and a mandrel bottom end, the top mandrel end being received in an annular cavity between the inner and outer sidewalls and forcibly reciprocatable within the cavity, and the mandrel bottom end including annular sealing means for high pressure sealing engagement with a top end of a casing of the well;

b) mounting at least one high pressure valve above the apparatus;

c) closing the at least one high pressure valve;

e) fully opening the blowout preventer;

f) stroking the mandrel of the apparatus through the blowout preventer until the annular sealing means is in fluid tight sealing engagement with a top of the casing of the well;

g) stimulating or fracturing the well by pumping high pressure fluids and/or proppants through the at least one high pressure valve and the apparatus into the casing of the well using at least one high pressure valve attached to the at least one high pressure valve;

h) stroking the mandrel out of the blowout preventer;

i) closing the blowout preventer;

j) bleeding off the fluid pressure in the at least one high pressure line;

k) removing the at least one high pressure line; and l) removing the apparatus and the at least one high pressure valve.

The apparatus in accordance with the invention comprises a spool which may be mounted above a blowout preventer that is mounted either directly or indirectly to a surface casing spool. The spool includes inner and outer concentric walls which are spaced apart to form an annular cavity that accommodates a mandrel having a mandrel top end that is forcibly reciprocatable within the cavity using fluid pressure, and a mandrel bottom end which includes a sealing means for sealingly engaging a top end of a casing of the well. In a preferred embodiment of the invention, the sealing means is an annular sealing body of plastics or rubber material bonded to a packoff bottom end of an extension for the mandrel. In the preferred embodiment, the sealing means is adapted to abut a bit guide surrounding a top end of the casing and to seal against it. A top end of the spool in accordance with the invention is adapted for the attachment of a high pressure valve, a spool header, or a valve spool through which well stimulation fluids can be pumped, and an adapter spool or a union such as a thread half or a Bowen union through which wireline, coil tubing or service tools can be run.

The spool in accordance with the invention for protecting BOPs can therefore be used in a novel method of servicing wells which permits tools such as logging tools, perforating guns, plugs, plug setting tools, fishing tools and related equipment to be used during the well servicing operation, thus permitting the servicing of multi-zone wells to proceed without interruption. This is an important advantage because it obviates the necessity of having service rigs set up and taken down for each production zone of a multi-zone well. The spool in accordance with the invention for protecting BOPs can also be used in a high pressure wellhead assembly that includes a high pressure valve spool and a high pressure adapter spool that has a tubing pin machined into it. This permits a tubing string to be hung through the complete wellhead assembly. The tubing string may be a production tubing already in the well or a coil tubing string run in for the job. The tubing string can be used as a dead string for measuring downhole pressure during the well stimulation treatment. In that case, well stimulation fluids are pumped through the high pressure valve spool which preferably includes at least two high pressure ports. If coil tubing is used, the top end of the coil tubing is preferably protected from abrasion by a length of "blast joint" that surrounds the tubing to prevent erosion. Alternatively, a Bowen union can be fitted to a top of the adapter spool to permit wireline, perforating guns, plug setters or other tools to enter the wellhead without obstruction. Or, a high pressure valve can be mounted to the adapter flange so that high pressure fluids can be pumped through up to three ports simultaneously to permit very high volume injections into the well.

BRIEF DESCRIPTION OF THE DRAWINGS

The invention will now be explained in more detail by way of example only, and with reference to the following drawings, wherein.

DETAILED DESCRIPTION OF THE PREFERRED EMBODIMENT

Figure 1:
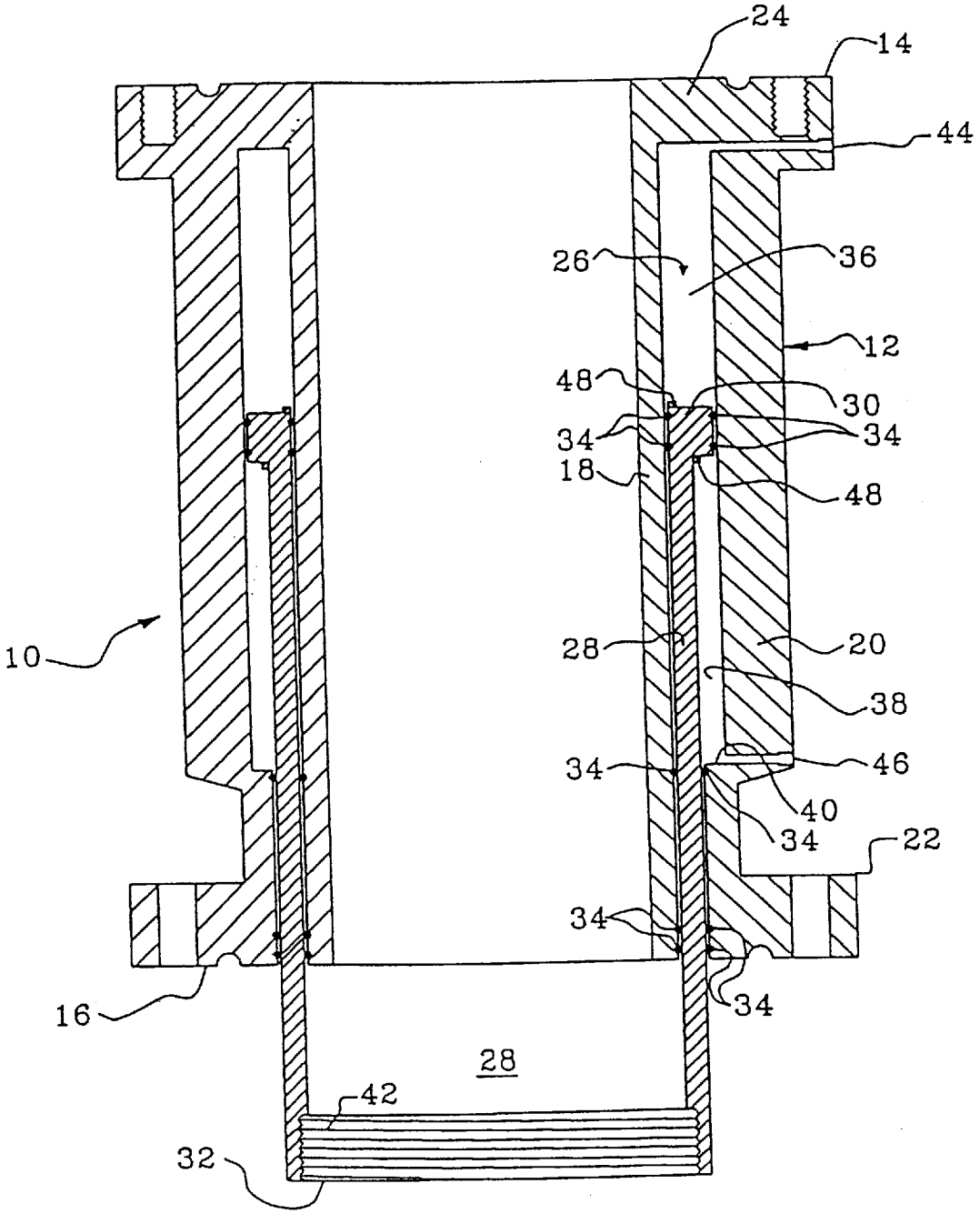
FIG. 1 shows a longitudinal cross-sectional view of a blowout preventer protector in accordance with the invention, showing the mandrel in a partially stroked-out position.

FIG. 1 shows a cross-sectional view of the apparatus for protecting BOPs (hereinafter BOP protector) in accordance with the invention, generally indicated by the reference 10. The apparatus includes a hollow spool 12 having a spool top end 14 and a spool bottom end 16 with an inner sidewall 18 and an outer sidewall 20 arranged in a space-apart relationship. The spool bottom end 16 includes a bottom flange 22 which is adapted for fluid tight connection with a top end of a BOP or a casing spool, as will be explained below in further detail. The spool top end 14 includes a top flange 24 which is adapted for attachment in a fluid tight relationship to a high pressure valve or a spool header, as will also be explained in more detail below. The top flange 24 is connected, preferably by welding or the like, to the inner sidewall 18 and the outer sidewall 20 to form an annular cavity 26 that preferably extends from the spool bottom end 16 to the top flange 24. A mandrel 28 having a mandrel top end 30 and a mandrel bottom end 32 is received in the annular cavity 26 and forcibly reciprocatable within the cavity. The mandrel top end 30 preferably has an inverted L-shape and extends across the annular cavity 26. A pair of O-rings 34 are retained on opposite sides of the mandrel top end 30 to provide a fluid resistant seal between the mandrel 28 and the walls of the annular cavity 26 to form an upper chamber 36 and a lower chamber 38 of respectively variable volumes which change as the mandrel 28 is forcibly reciprocated within the annular cavity 26. A step 40 in the annular cavity 28 forms a constriction to facilitate sealing the lower chamber 38 to inhibit fluid from leakage around the spool bottom end 16. Spaced below the step 40 are a pair of O-rings 34 retained in the inner surface of the inner sidewall 18 and the outer sidewall 20. Likewise, positioned adjacent the spool bottom end 16 is a second set of O-rings 34 to inhibit the migration of abrasive and corrosive fluids, to which the mandrel 28 is exposed, into the lower chamber 38. Preferably, the mandrel 28 is dimensioned in length so that when the mandrel top end 30 is reciprocated to a top of the chamber 26, the mandrel bottom end 32 is positioned above the set of O-rings 34 adjacent the bottom wall 16 to permit those O-rings to be changed because they are the set of O-rings most prone to wear due to their exposure to corrosive and/or abrasive substances. An internal thread connector 42 on the mandrel bottom end 32 is adapted for the connection of mandrel extension sections having the same diameter as the diameter of the mandrel 28. The extension sections (not illustrated) permit the mandrel 28 to be lengthened in case a header spool (not illustrated) or the like is located between the mandrel 28 and a BOP to be protected. The connector 42 may likewise be an external thread, or any other type of secure connecting arrangement.

The outer sidewall 20 of the spool 12 further includes a first port 44 for injecting pressurized fluid into the upper chamber 36 of the annular cavity 26 to forcibly stroke the mandrel 28 downwardly. The outer sidewall 20 also includes a second port 46 for injecting pressurized fluid into the lower chamber 38 to stroke the mandrel upwardly in the annular cavity 26. Attached to a top surface of the top mandrel end 30 is a rib 48 which acts as a spacer to ensure that when the mandrel is at the top of its stroke, pressurized fluid can be injected into the cavity 26 to stroke the mandrel downwardly. A corresponding rib 48 is located on the bottom surface of the mandrel top end 30 and serves the same purpose. In order to stroke the mandrel upwardly and downwardly, pressurized fluid lines are connected to the first port 44 and the second port 46. The pressurized fluid is preferably a hydraulic fluid but may also be, for example, compressed air. If hydraulic fluid is used for stroking the mandrel upwardly and downwardly in the annular cavity 26, a small hydraulic hand pump may be used or hydraulic pump lines may be connected to the first port 44 and the second port 46. In either case, pressurized fluid is introduced into one port and fluid is drained from the other port as the mandrel is stroked upwardly or downwardly in the annular cavity 26.

Figure 2:
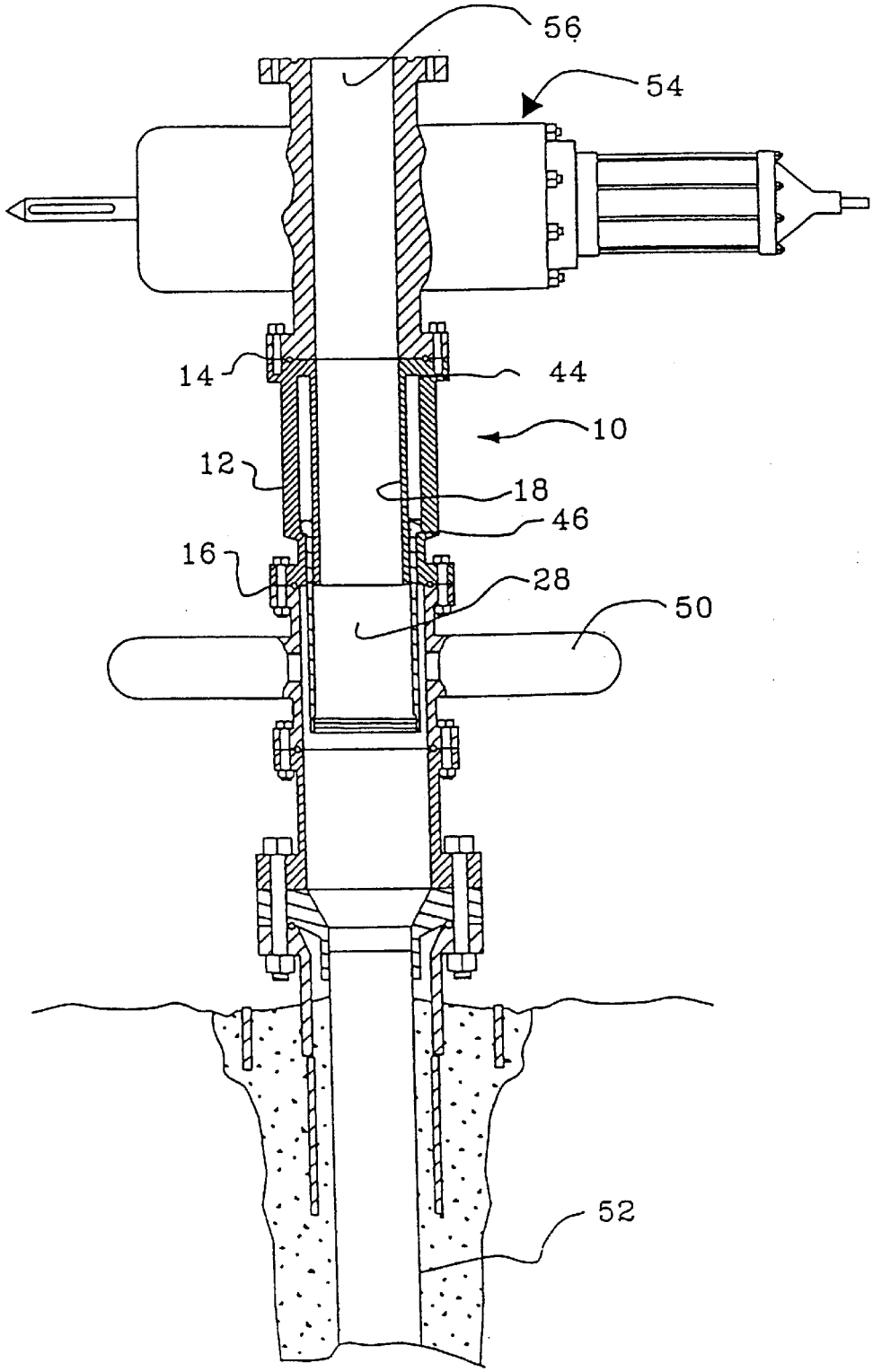
FIG. 2 shows a cross-sectional view of the blowout preventer protector shown in FIG. 1 attached to a blowout preventer on a wellhead and in a position for performing well stimulation procedures.

FIG. 2 shows the BOP protector 10 in accordance with the invention mounted to a BOP 50 which is in turn connected to a well casing 52 by various casing headers and hangers, well known in the art. The BOP 50 is a piece of wellhead equipment that is well known in the art and its construction and function do not form a part of this invention. The BOP 50 and related spools and hangers are therefore shown schematically and are not described. Mounted above the BOP protector 10 is a high pressure valve 54. The high pressure valve 54 is preferably a hydraulically operated valve having a pressure rating that is at least as high as the pressure rating of the BOP 50, and a passage 56 having a diameter that is at least as large as the internal diameter of the casing 52 to permit oil and gas well servicing tools to be inserted through the valve 54 and into the well casing 52.

As is apparent, the inner sidewall 18 of the BOP protector 10 has an internal diameter which is substantially equal to the diameter of the casing 52. As shown in FIG. 2, the mandrel 28 has been stroked downwardly through the BOP 50 and the well is ready to be serviced. The annular passage defined by the inner sidewall 18 of the BOP protector 10 and the casing 52 is unrestricted so that tools such as perforating guns, plug setters, logging tools, fishing tools and the like may be inserted through the BOP protector 10 and into the casing 52. This permits wells with more than one production zone to be serviced without interruption which is a distinct advantage over prior art casing savers and well casing packers that restrict access to the casing due to a constriction of the diameter of the passage between a high pressure valve 54 and the casing 52.

The invention also provides a method of fracturing or stimulating a well having a blowout preventer 50 located above the casing 52 using the BOP protector 10 in accordance with the invention. In accordance with the method, the BOP protector 10 is mounted above the BOP 50 and a high pressure valve 54 is mounted above the BOP protector 10. The high pressure valve 54, commonly called a "frac" valve, is well known in the art and its structure and function will not be further explained. A high pressure line (not illustrated) is connected to the high pressure valve and pressurized fluid is pumped into the BOP protector 10 while the BOP 50 is still closed to ensure that a fluid tight seal exists between the BOP 50 and the BOP protector 10, as well as between the BOP protector 10 and the high pressure valve 54. If no pressure leaks are detected between the spool top end 14 or the spool bottom end 16 of the spool 12, the high pressure valve 54 is closed and the BOP 50 is fully opened. Pressurized fluid is injected through the first port 44 using a pneumatic or hydraulic line attached to that port, and drained from the second port 46 using a pneumatic or hydraulic line. The pressurized fluid strokes the mandrel 28 down through the BOP 50. When the mandrel 28 reaches a bottom of its stroke, the pressure in the pressurized fluid injected into the first port 44 rises dramatically to indicate that the mandrel 28 has reached the bottom of its stroke and the well is ready for servicing. Stimulation or fracturing of the well may then commence by pumping abrasive and/or corrosive fluids through a high pressure line (not illustrated) attached to the high pressure valve 54.

If the well being serviced has several production zones, the stimulation process may proceed sequentially from zone to zone because tools such as logging tools, perforating guns, plug setters and other well servicing tools (not illustrated) can be introduced through the high pressure valve 54 and inserted directly into the well casing 52 without removing the BOP protector 10. In general, multi-zone wells are stimulated one production zone at a time from the bottom of the well up. This is usually accomplished in a sequence which includes logging the production zone; inserting a plug in the casing at a bottom of the production zone; perforating the casing in the area of the production zone, if necessary; stimulating the production zone by fracturing and/or acidizing or the like; and, flowing back the stimulation fluids before recommencing the process for the next production zone. The ability to perform all these operations with the BOP protector 10 in place greatly facilitates well service operations and contributes significantly to the economy of servicing wells. After the last production zone of a well has been serviced, the fracturing and/or stimulating fluids may be flowed back through the high pressure valve 54 before the BOP protector 10 is removed from the BOP 50 or after the BOP protector 10 is removed from the BOP 50, as the operator chooses. In either case, when the BOP protector 10 is no longer needed, the mandrel 28 is stroked upwardly out of the BOP 50 by injecting pressurized fluid into the second port 46 while draining it from the first port 44 until a dramatic rise in the resistance to the injected pressurized fluid indicates that the mandrel 28 is completely stroked out of the BOP 50. The BOP 50 is then closed, the high pressure valve 54 is removed from the top of the BOP protector 10 and the BOP protector 10 is removed from the BOP 50. A wellhead or other terminating equipment can then be mounted to the BOP 50 and normal hydrocarbon production can commence or resume. Since the mandrel 28 protects the BOP 50 from direct contact with abrasive and/or corrosive fluids used during the well stimulation process, the BOP 50 is not damaged and there is no risk that the blind rams or the tubing rams of the BOP 50 will be "washed out" by the abrasive action of a high volume of proppants pumped into the well. Since damage to BOPs is eliminated and the risk of having to kill or plug the well before and after treatment is obviated, the present invention contributes significantly to the economy of well stimulation treatments conducted at moderate fluid pressures.

Figure 3:
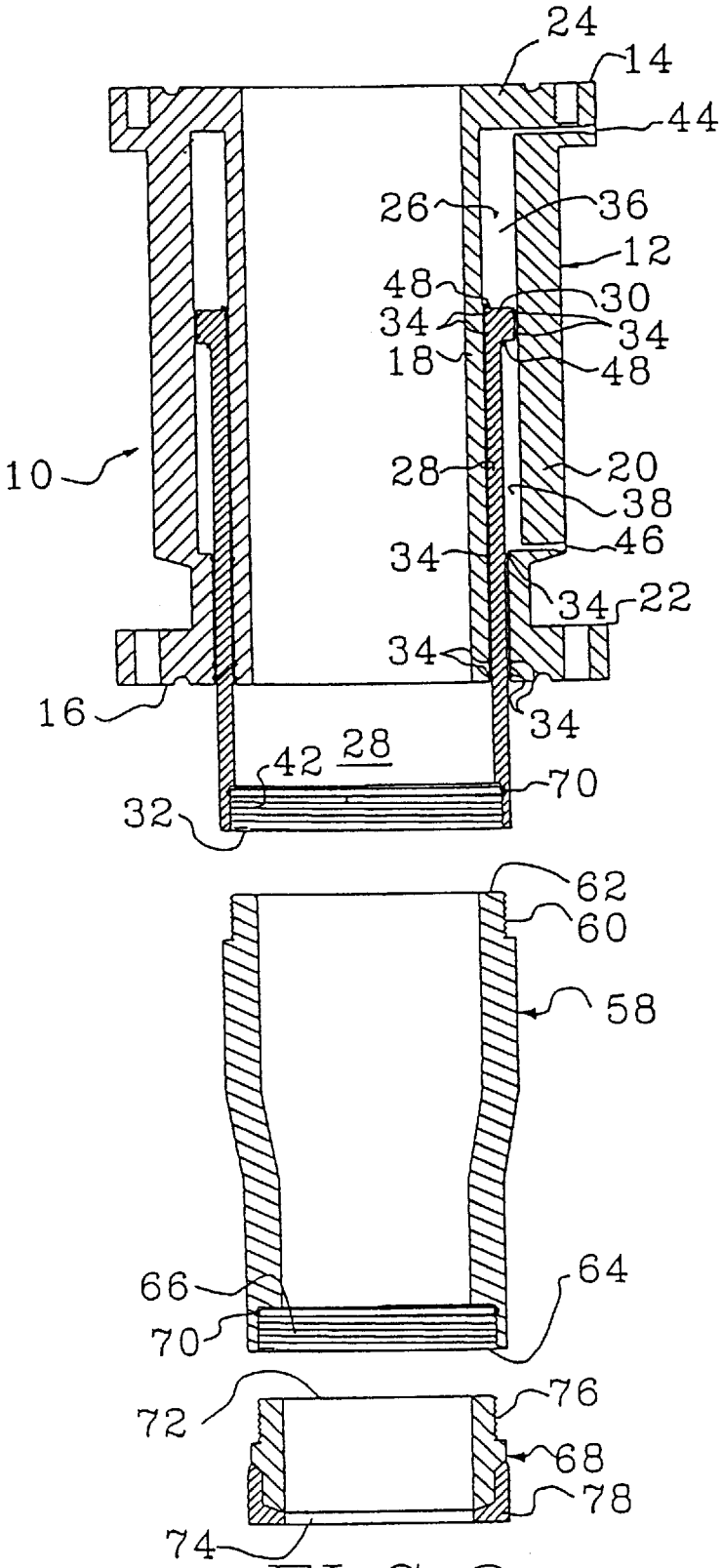
FIG. 3 is a cross-sectional view of a blowout preventer protector in accordance with another embodiment of the invention wherein the blowout preventer protector includes an annular seal for isolating the blowout preventer on the wellhead from fluid pressure used in well stimulation treatments.

FIG. 3 shows a cross-sectional view of the BOP protector 12 and two preferred extensions for adapting the BOP protector 10 for service in well treatments up to pressures which approach the burst pressure of the well casing 52 (about 15,000 psi). In the preferred embodiment a mandrel extension 58 is threadedly connected to a bottom end 32 of the mandrel 28 using a threaded connector 60 at a top end 62 of the mandrel extension 58. An extension bottom end 64 of the mandrel extension 58 includes a threaded connector 66 that is used to connect a mandrel packoff assembly 68, which will be described below in more detail. High pressure O-ring seals 70, well known in the art, provide a high pressure fluid seal in the threaded connectors between the mandrel 28, the mandrel extension 58 and the mandrel packoff assembly 68. The mandrel 28, the mandrel extension 58 and the mandrel packoff assembly 68 are each made from 4140 steel, a steel which is commercially available, has a high tensile strength and a Bumell hardness of about 300. Consequently, they are adequately robust to withstand extreme pressures of up to 15,000 psi. In order to support a packoff gasket 78, however, the walls of the mandrel packoff assembly 68 are preferably about 1.75" (4.45 cm) thick. As will be explained below with reference to FIG. 4, it is preferable that the wall thickness of the mandrel packoff assembly 68 be such that it fits closely within the tubing head 82 of a well being treated.

The mandrel packoff assembly 68 includes a packoff upper end 72 and a pack off lower end 74. The packoff upper end includes a threaded connector 76 which engages the threaded connector 66 on the extension bottom end 64 of the mandrel extension 58. The packoff lower end 74 of the mandrel packoff assembly 68 includes the annular seal 78 which sealingly engages a top of the well casing as will be described below with reference to FIG. 4. The annular seal 78 is preferably a thermoplastic or a synthetic rubber seal that is bonded directly to the packoff lower end 74 of the mandrel packoff assembly 68. The packoff lower end 74 of the mandrel packoff assembly 68 is preferably machined to provide a bearing surface to which the annular seal 78 may be bonded. As described above, the annular seal 78 is preferably made from a thermoplastic such as polyurethane or a rubber compound such as nitryl rubber. The annular seal 78 should have a hardness of about 80 to about 100 durometer. Experimentation has shown that either polyurethane or nitryl rubber in that hardness range is capable of providing a secure seal that will withstand up to at least about 15,000 psi if it is properly bonded to a mandrel packoff assembly 68 that is properly sized to fit snugly in a tubing head, as will be explained below. The internal diameter of the mandrel packoff assembly 68 is at least as large as the internal diameter of the casing 52, e.g. 5" (12.7 cm).

It will be understood by those skilled in the art that the mandrel extension 58 and the mandrel packoff assembly 68 can be constructed as a single unit, although this is not preferred for reasons that will be explained below. It will be further understood that a mandrel packoff assembly 68 having a thinner wall than that of the preferred embodiment could be constructed. It will be further understood that the annular seal 78 may be formed on the bottom end 32 of a mandrel 28, if the mandrel is sized on its mandrel bottom end 32 to fit within a tubing head, or the like.

Figure 4:
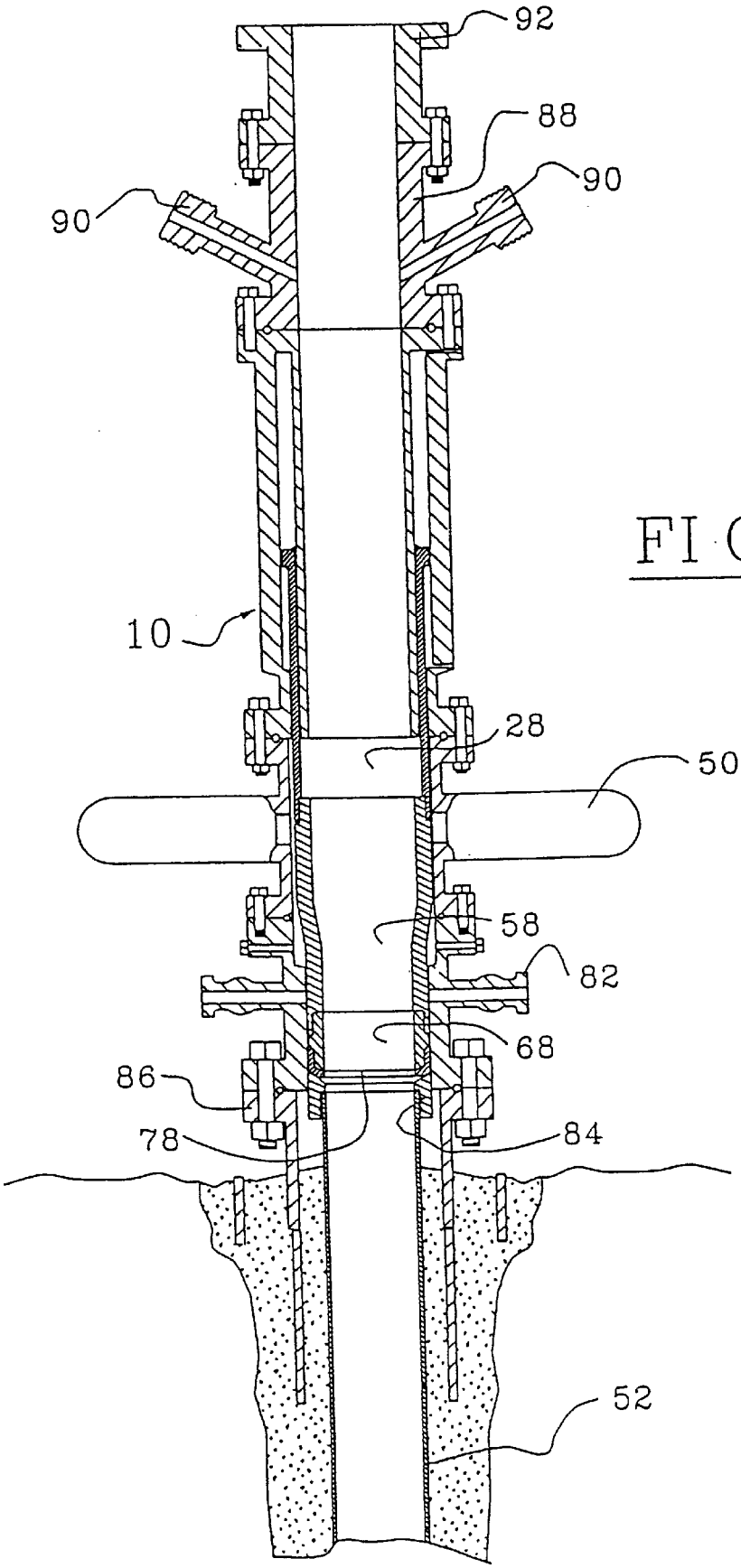
FIG. 4 is a cross-sectional view of a blowout preventer protector and related spools mounted on a wellhead above a blowout preventer and stroked through the blowout preventer in a position for a well stimulation treatment.

FIG. 4 shows a BOP protector for high pressure treatments as shown in FIG. 3 in an assembled condition mounted to a BOP 50 and stroked down through the BOP 50 and a well tubing head 82 into sealing contact with a bit guide 84 attached to a top of the casing 52. The bit guide 84 is a common component of wellhead assemblies and it caps the casing 52 to protect the top end of the casing 52 and to provide a seal between the casing 52 and a casing spool 86 in a manner well known in the art. The mandrel 28, the mandrel extension 58 and the mandrel packoff assembly 68 are stroked down through the BOP 50 and the well tubing head 82 using pressurized fluid, such as hydraulic fluid injected through hydraulic fluid port 44, as described above with reference to FIG. 2. It has been established through experimentation that hydraulic fluid injected at a pressure of about 1,000 psi is adequate to seat the annular seal 78 against the bit guide 84 with enough force to ensure a fluid tight seal capable of withstanding extreme pressures of up to about 15,000 psi. The hydraulic fluid pressure in the upper chamber 36 should be maintained at about 1,000 psi at all times while the BOP protector 10 is in use.

As shown in FIG. 4, it is preferable that the mandrel packoff assembly 68 fit closely within the tubing head 82 so that the outer wall of the annular seal 28 is supported against an inner wall of the tubing head when the annular seal 78 is seated against the bit guide 84. Since the internal diameter of tubing heads vary somewhat depending on the manufacturer and/or the model number, it is preferable that a mandrel packoff assembly having an outer wall of a corresponding diameter be provided for each diameter of tubing head expected to be encountered. This is most readily accomplished by varying the wall thickness of the mandrel packoff assembly 68. Making the mandrel packoff assembly 68 fit closely within the central bore of the tubing head 82 is simply a precautionary measure to ensure maximum safety. It has not been established that the annular seal 78 will fail if the mandrel packoff assembly does not fit closely within the tubing head 82.

Mounted to a top of the BOP protector 10 is a high pressure valve spool 88 which preferably includes at least 2, 3" (7.62 cm) unions 90 for the connection of high pressure lines. The unions 90 include passageways which connect with the central bore of the high pressure valve spool 88 to permit fluids to be pumped into the well casing 52 using 3" (7.62 cm) high pressure lines (not illustrated) in a manner well known in the art. Mounted to a top of the high pressure valve stool 88 is an adapter spool 92. The adapter spool provides a mounting for a tubing hanger (not illustrated) a high pressure valve 54 (see FIG. 2) or a union (such as a Bowen union, well known in the art) for letting wire line, perforating guns, etc. into the well. The adapter flange 92 can have a tubing pin (not illustrated) machine into it to permit a tubing string (see FIG. 5) to be hung through the complete well head assembly.

In use, the BOP protector 10 is mounted above the BOP 50 and the high pressure valve spool 88 is mounted to the top of the BOP protector 10. Both units may also be mounted in unison as a single preassembled unit. An adapter spool or a union may be mounted above the high pressure valve spool 88. If an adapter spool 98 is mounted to the high pressure valve spool 88, a top end of the adapter spool 92 is closed with a high pressure valve, a Bowen union, or the like to contain any natural well pressure and the BOP 50 is opened to its fullest extent. The mandrel 28 with its extension 58 and packoff assembly 68 are then stroked down through the BOP 50 until the packoff assembly 68 sealingly engages the bit guide 84. A sealing engagement is indicated when the hydraulic fluid pressure in the upper chamber 36 of the annular cavity 26 (see FIG. 3) reaches about 1,000 psi. Well stimulation fluids can then be pumped through high pressure lines connected to the 3" unions 90 and/or through a high pressure valve 54 (see FIG. 2) mounted to a top end of the high pressure valve spool 88 or to the adapter spool 92. Likewise, a union such as a 5" Bowen union (not shown) may be connected to a top end of the adapter flange 92 or the high pressure valve spool 88 to permit an operator to run wire line, perforating guns or logging tools down through the well head at almost any time during a well stimulation procedure when fluids are not being pumped into the well.

Figure 5:
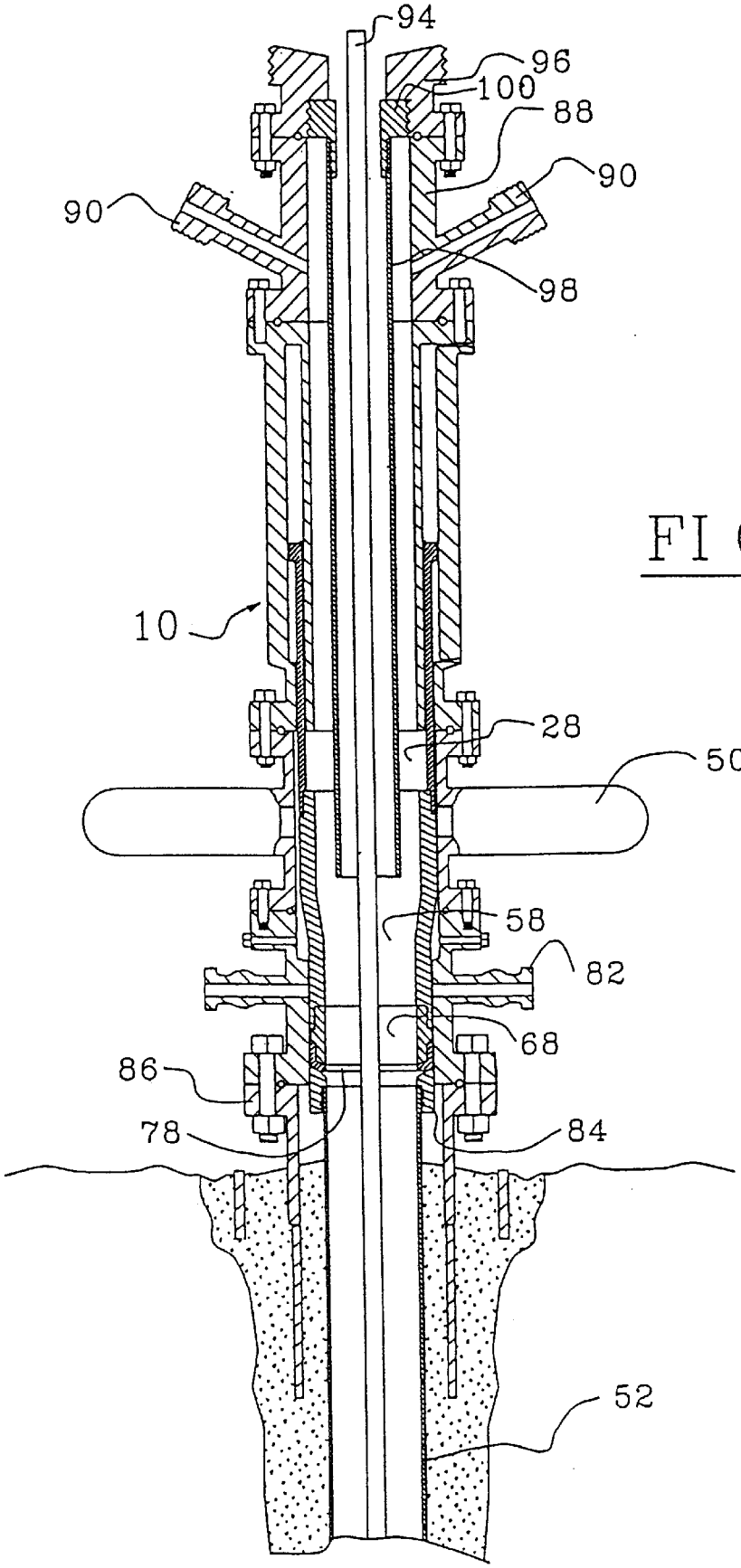
FIG. 5 is a cross-sectional view of a blowout preventer protector and related spools mounted on a well head above a blowout preventer and stroked through the blowout preventer, with a coil tubing run into the well to serve as a dead string for monitoring downhole pressures during well stimulation treatments.

The BOP protector 10 may also be used in other configurations for fracturing a well or stimulating the production of a well during a completion, recompletion or a well stimulation treatment, as shown in FIG. 5. For example, a tubing string 94 can be run through a 3" half thread union 96 attached to a top end of the high pressure valve spool 88. The 3" half thread union 96 is for example, a 1502 union available from Weco Corp., which is rated for 15,000 psi. The tubing string 94 serves as a dead string in the well. The dead string may be used to monitor downhole pressures and thus permits fracturing crews to detect "bridging off," which is explained below. The dead string can also be used to "flow back" proppants by pumping water down through it to flush the proppants up out of the well. It can likewise be used to inject methanol if a "freeze-up" occurs. These and other possibilities make the potential for having a tubing string in the well during a well stimulation treatment very important. If the tubing string 94 is a coil tubing, it is preferably run through an 8' (2.3 m) length of "blast joint" 98 that hangs from a 3½" adapter pin 100. The blast joint 98 protects the coiled tubing string from being eroded by the abrasive proppants pumped at high pressure through the 3" unions 90. The coiled tubing string 94 is typically a 1½" tubing and, as explained above, it is used as a dead string which permits an operator to measure downhole pressure during well fracturing or stimulation. If the well already contains a production tubing, it can be left in the well and used as a dead string as well, in which case it is preferably hung from the adapter pin 100. A dead string provides an important advantage because a pressure reading taken at the wellhead is not necessarily representative of the downhole pressure at the production zone. Large quantities of proppants are frequently used during well stimulation treatments. To facilitate pumping and dispersion in the production zone, those proppants are usually treated with lubricating gels, which may be cross-linked or linear polymer gels or mixtures of the two. The gels and/or gel mixtures work best when they are matched to suit specific well conditions. If the gel or gel mixture is not suited to the well condition, a phenomenon called "bridging-off" can occur. In bridging off, a blockage occurs in the casing above the production zone and although the pressure reading at the wellhead is very high, there may be virtually no pressure induced in the production zone. Without a dead string it is difficult, if not impossible, to detect when bridging-off occurs. With the dead string the pressure in the casing at the production zone can be monitored to help ensure that the stimulation treatment is effective and to permit crews to readily detect the problem if bridging-off occurs.

Those skilled in the art will appreciate that this invention provides a great deal of flexibility in the stimulation treatment of wells and permits wells to be treated at extreme pressures of 10,000 psi or more. With the well casing 52 fully accessible, and the BOP 50 completely isolated from fluid pressure and abrasion or corrosion, there is no real limit to the type or extent of stimulation, completion, recompletion or maintenance operation that may be performed with the BOP protector 10 in place.

Modifications and improvements to the above described embodiment of the invention may become apparent to those skilled in the art. The foregoing description is intended to be exemplary rather than limiting. The scope of the invention is therefore intended to be limited solely by the scope of appended claims.

I claim:

1. Apparatus for protecting a blowout preventer from exposure to fluid pressure as well as abrasive and/or corrosive fluids during a well fracturing and/or stimulation treatment to stimulate production, comprising:

a spool having a spool top end, a spool bottom end, and spaced-apart inner and outer sidewalls that extend between the spool top end and the spool bottom end;

the spool bottom end adapted to be mounted above a blowout preventer;

the spool top end adapted for the attachment of another spool, or a union;

a mandrel having a mandrel top end and a mandrel bottom end, the mandrel top end being received in an annular cavity between the inner and outer sidewalls and forcibly reciprocatable within the cavity, and the mandrel bottom end including annular sealing means for high pressure sealing engagement with a top end of a casing of the well;

whereby, when the spool is mounted above a blowout preventer, the mandrel can be stroked down through the blowout preventer until the sealing means sealingly engages a top end of the casing to isolate the blowout preventer and protect it from exposure to fluid pressure as well as abrasive and/or corrosive fluids during well stimulation treatments, and stroked up out of the blowout preventer after the well has been stimulated.

2. Apparatus for protecting a blowout preventer from exposure to fluid pressure as well as abrasive and/or corrosive fluids during a well fracturing and/or stimulation treatment as claimed in claim 1 wherein the annular sealing means is bonded to the bottom end of the mandrel.

3. Apparatus for protecting a blowout preventer from exposure to fluid pressure as well as abrasive and/or corrosive fluids during a well fracturing and/or stimulation treatment as claimed in claim 2 wherein the annular sealing means is formed from a plastics material.

4. Apparatus for protecting a blowout preventer from exposure to fluid pressure as well as abrasive and/or corrosive fluids during a well fracturing and/or stimulation treatment as claimed in claim 3 wherein the plastics material is a polyurethane having a hardness of 80–100 durometer.

5. Apparatus for protecting a blowout preventer from exposure to fluid pressure as well as abrasive and/or corrosive fluids during a well fracturing and/or stimulation treatments as claimed in claim 2 wherein the annular sealing means is formed from a rubber material.

6. Apparatus for protecting a blowout preventer from exposure to fluid pressure as well as abrasive and/or corrosive fluids during a well fracturing and/or stimulation treatment as claimed in claim 5 wherein the rubber material is a nitryl rubber having a durometer hardness of 80–100 durometer.

7. Apparatus for protecting a blowout preventer from exposure to fluid pressure as well as abrasive and/or corrosive fluids during a well fracturing and/or stimulation treatment as claimed in claim 1 wherein the spool top end includes a top flange that is connected in a fluid tight relationship with the inner and the outer sidewalls of the spool.

8. Apparatus for protecting a blowout preventer from exposure to fluid pressure as well as abrasive and/or corrosive fluids during a well fracturing and/or stimulation treatment as claimed in claim 7 wherein the spool bottom end includes a bottom flange that is connected to only the outer sidewall of the spool.

9. Apparatus for protecting a blowout preventer from exposure to fluid pressure as well as abrasive and/or corrosive fluids during a well fracturing and/or stimulation treatments as claimed in claim 8 wherein the annular cavity between the inner and outer sidewalls extends from the bottom flange to the top flange of the spool.

10. Apparatus for protecting a blowout preventer from exposure to fluid pressure as well as abrasive and/or corrosive fluids during a well fracturing and/or stimulation treatment as claimed in claim 1 wherein the spool bottom end includes a bottom flange and the annular cavity is constricted above the bottom flange to facilitate sealing the annular cavity and to prevent the mandrel from being ejected from the annular cavity when the mandrel is stroked down through the blowout preventer.

11. Apparatus for protecting a blowout preventer from exposure to fluid pressure as well as abrasive and/or corrosive fluids during a well fracturing and/or stimulation treatments as claimed in claim 1 wherein the bottom end of the mandrel is adapted to permit the connection of mandrel extension sections to permit the length of the mandrel to be increased and the annular sealing means is bonded to a last of the extension sections.

12. Apparatus for protecting a blowout preventer from exposure to fluid pressure as well as abrasive and/or corrosive fluids during a well fracturing and/or stimulation treatment as claimed in claim 1 wherein the mandrel is forcibly reciprocated within the annular cavity by fluid pressure injected through a first port located at a top of the annular cavity and a second port located at a bottom of the annular cavity.

13. Apparatus for protecting a blowout preventer from direct exposure to abrasive and/or corrosive fluids during a well fracturing and/or stimulation treatment as claimed in claim 1 wherein an internal diameter of the mandrel is at least as large as an internal diameter of the casing.

14. Apparatus for protecting a blowout preventer from exposure to fluid pressure as well as abrasive and/or corrosive fluids during well fracturing and/or stimulation treatment to stimulate production, wherein the well has a well casing comprising:

a hollow spool having a spool top end, a spool bottom end, and spaced-apart inner and outer sidewalls that extend between the spool top end and the spool bottom end;

the spool bottom end including a bottom flange adapted for attachment in a fluid tight relationship with a top end of a blowout preventer or a spool, the bottom flange being affixed to the outer sidewall of the hollow spool;

the spool top end including a top flange adapted for attachment in a fluid tight relationship to a high pressure valve, a valve spool, an adapter spool or a union, the top flange being affixed to both the inner and the outer sidewalls of the hollow spool so that an annular cavity that extends from the spool bottom end to the top flange is formed between the inner and outer sidewalls;

a mandrel having a mandrel top end and a mandrel bottom end, the mandrel top end being received in the annular cavity and forcibly reciprocatable within the cavity and the mandrel bottom end terminating in annular sealing means for fluid tight sealing engagement with a top end of a casing of the well;

first sealing means for providing a fluid resistant seal between the mandrel top end and the respective inner and outer sidewalls so that the annular cavity is partitioned into upper and lower chambers of respectively variable volumes;

second sealing means for providing a fluid resistant seal between the mandrel and the spool bottom end to inhibit pressurized fluid in the lower chamber from leaking from that chamber;

a first port for injecting pressurized fluid into or draining pressurized fluid from the upper chamber and a second port for injecting pressurized fluid into or draining pressurized fluid from the lower chamber, whereby, when the spool is mounted above the blowout preventer, the mandrel can be stroked down through the blowout preventer to engage a top end of the casing in a fluid tight seal to protect the blowout preventer from exposure to fluid pressure as well as abrasive and/or corrosive fluids during well stimulation treatments, and stroked up out of the blowout preventer after the well has been stimulated.

15. An apparatus for protecting blowout preventers as claimed in claim 14 wherein the annular sealing means is bonded to the bottom end of the mandrel.

16. An apparatus for protecting blowout preventers as claimed in claim 15 wherein the annular sealing means is made from a thermoplastics material.

17. An apparatus for protecting blowout preventers as claimed in claim 16 wherein the thermoplastics material is a polyurethane having a hardness of 80–100 durometer.

18. An apparatus for protecting blowout preventers as claimed in claim 15 wherein the annular sealing means is made from a rubber material.

19. An apparatus for protecting blowout preventers as claimed in claim 18 wherein the annular sealing means is made from a nitryl rubber having a hardness of 80–100 durometer.

20. An apparatus for protecting blowout preventers as claimed in claim 14 wherein the inner sidewall of the spool has an internal diameter that is at least as large as an internal diameter of a casing of the well.

21. An apparatus for protecting blowout preventers as claimed in claim 14 wherein the annular cavity is constricted at the spool bottom end to facilitate sealing the cavity with the second sealing means, and the mandrel top end is enlarged to prevent the mandrel from being ejected from the cavity when pressurized fluid is injected into the first port and drained from the second port.

22. An apparatus for protecting blowout preventers as claimed in claim 14 wherein the mandrel bottom end is adapted for the connection of extension sections to permit the length of the mandrel to be extended and a last of the extension sections connected to the mandrel includes the annular sealing means.

23. An apparatus for protecting blowout preventers as claimed in claim 14 wherein the first and second sealing means comprise O-rings.

24. An apparatus for protecting blowout preventers as claimed in claim 23 wherein the second sealing means comprises a first set of O-rings arranged on opposite sides of the mandrel remote from the spool bottom end and a second set of O-rings arranged on opposite sides of the mandrel adjacent the spool bottom end.

25. An apparatus for protecting blowout preventers as claimed in claim 22 wherein the mandrel is adapted to be stroked up past the second set of O-rings so that the O-rings in that set can be replaced.

26. An apparatus for protecting blowout preventers as claimed in claim 14 wherein the pressurized fluid is hydraulic fluid.

27. An apparatus for protecting blowout preventers as claimed in claim 14 wherein the pressurized fluid is compressed air.

28. A method of fracturing or stimulating a well having at least one blowout preventer attached to a casing of the well, comprising the steps of:

a) mounting above the blowout preventer an apparatus for protecting the blowout preventer from exposure to fluid pressure as well as abrasive and/or corrosive fluids during the well fracturing and/or stimulation treatment to stimulate production, the apparatus comprising a protector spool having a spool top end, a spool bottom end, and spaced-apart inner and outer sidewalls that extend between the spool top end and the spool bottom end, the spool bottom end being adapted to be mounted above the blowout preventer; the spool top end being adapted for the attachment of another spool or a union, and a mandrel having a mandrel top end and a mandrel bottom end, the mandrel top end being received in an annular cavity between the inner and outer sidewalls and forcibly reciprocatable within the cavity, and the mandrel bottom end including annular sealing means for high pressure sealing engagement with a top end of a casing of the well;

b) mounting at least one high pressure valve above the apparatus;

c) closing the at least one high pressure valve;

d) fully opening the blowout preventer;

e) stroking the mandrel of the apparatus through the blowout preventer until the annular sealing means is in fluid tight sealing engagement with a top of the casing of the well;

f) stimulating or fracturing the well by pumping high pressure fluids and/or proppants through the at least one high pressure valve and the apparatus into the casing of the well using at least one high pressure line attached to the at least one high pressure valve;

g) stroking the mandrel out of the blowout preventer;

h) closing the blowout preventer;

i) bleeding off fluid pressure in the high pressure line;

j) removing the high pressure line;

k) removing the apparatus and the at least one high pressure valve.

29. A method of fracturing or stimulating a well having at least one blowout preventer attached to a top of a casing of the well as claimed in claim 28 further including a step of connecting a union above the protector spool.

30. A method of fracturing or stimulating a well having at least one blowout preventer attached to a top of a casing of the well as claimed in claim 28 further including a step of running a logging tool attached to a wire line through the union and down the casing to log a second production zone of the well after stimulating or fracturing a first zone of the well and before stroking the mandrel out of the blowout preventer.

31. A method of fracturing or stimulating a well having at least one blowout preventer attached to a top of a casing of the well as claimed in claim 28 further including a step of running a plug setting tool through the union and inserting a plug in the casing between the first and second production zones of the well after logging the second production zone.

32. A method of fracturing or stimulating a well having at least one blowout preventer attached to a casing of the well as claimed in claim 31 further including a step of inserting a perforating gun into the well through the union after inserting the plug and perforating the casing in an area of the second production zone of the well located above the plug.

33. A method of fracturing or stimulating a well having at least one blowout preventer attached to a casing of the well as claimed in claim 32 further including a step of fracturing or stimulating the second production zone of the well by pumping high pressure fluids and/or proppants through the at least one high pressure valve and the apparatus into the casing of the well.

34. A method of fracturing or stimulating a well having at least one blowout preventer attached to a casing of the well as claimed in claim 33 further including repeating the steps of logging, plugging, perforating and fracturing or stimulating for all other production zones in the well before stroking the mandrel out of the blowout preventer.

35. A method of fracturing or stimulating a well having at least one blowout preventer attached to a top of a casing of the well as claimed in claim 29 wherein the union is a half thread union and further including a step of running coil tubing down the well through the half thread union.

36. A method of fracturing or stimulating a well having at least one blowout preventer attached to a top of a casing of the well as claimed in claim 35 further including a step of running the coil tubing through a blast joint to protect the coil tubing from abrasion.

37. A method of fracturing or stimulating a well having at least one blowout preventer attached to a top of a casing of the well as claimed in claim 35 further including a step of using the coil tubing as a dead string to measure downhole pressure during the fracturing or stimulation treatment.

38. A method of fracturing or stimulating a well having at least one blowout preventer attached to a top of a casing of the well as claimed in claim 28 wherein the annular sealing means engages a bit guide affixed to a top of the casing in the fluid tight seal.

39. A method of fracturing or stimulating a well having at least one blowout preventer attached to a top of a casing of the well as claimed in claim 28 wherein the mandrel comprises a mandrel extension and a mandrel packoff assembly, and the annular sealing means is bonded to a bottom end of the mandrel packoff assembly.

40. Apparatus for protecting a blowout preventer during well stimulation treatments, comprising:

a spool that includes inner and outer concentric walls which are spaced-apart to form an annular cavity that accommodates a mandrel having a top end that is forcibly reciprocatable within the annular cavity using fluid pressure, and a bottom end which includes an annular sealing body for sealing engagement with a top end of a casing of the well when the mandrel is stroked down through the blowout preventer into contact with the top end of the casing.

41. Apparatus for protecting a blowout preventer during well stimulation treatments as claimed in claim 40 wherein the annular sealing body is bonded to the bottom end of the mandrel.

42. Apparatus for protecting a blowout preventer during well stimulation treatments as claimed in claim 41 wherein the annular sealing body is a plastics material.

43. Apparatus for protecting a blowout preventer during well stimulation treatments as claimed in claim 42 wherein the plastics material is a polyurethane having a hardness of 80–100 durometer.

44. Apparatus for protecting a blowout preventer during well stimulation treatments as claimed in claim 41 wherein the annular sealing body is a rubber material.

45. Apparatus for protecting a blowout preventer during well stimulation treatments as claimed in claim 42 wherein the rubber material is a nitryl rubber having a hardness of 80–100 durometer.

* * * * *